United States Patent [19]

Znamirowski et al.

[11] 4,288,132

[45] Sep. 8, 1981

[54] METAL CABINET FOR ASSEMBLY BY THE USER FROM KNOCKED-DOWN CONDITION

[75] Inventors: Henry Znamirowski, Ellicott City; David J. Roles, Baltimore, both of Md.

[73] Assignee: Roper Corporation, Kankakee, Ill.

[21] Appl. No.: 122,447

[22] Filed: Feb. 19, 1980

[51] Int. Cl.[3] ..... A47B 43/00; F16B 12/00

[52] U.S. Cl. ..... 312/257 R; 312/257 SM; 312/263; 312/111; 312/108; 248/205 A

[58] Field of Search ..... 312/257 R, 257 SK, 257 SM, 312/257 A, 263, 107, 108, 111, 100, 101, 194; 248/205 A

[56] References Cited

U.S. PATENT DOCUMENTS

| | | | |
|---|---|---|---|
| 1,782,344 | 11/1930 | Gourley | 312/257 SK |
| 2,483,606 | 10/1949 | Albach et al. | 312/257 R |
| 2,667,401 | 1/1954 | Knuth | 312/257 R |
| 2,808,944 | 10/1957 | Jones et al. | 312/257 R |
| 2,869,953 | 1/1959 | Miller et al. | 312/257 R |
| 2,960,803 | 11/1960 | Bonistall | 248/205 A |
| 3,023,068 | 2/1962 | Haag | 312/263 |
| 3,065,038 | 11/1962 | Pipe | 312/263 |
| 3,186,782 | 6/1965 | Ullman, Jr. | 312/263 |
| 3,623,784 | 11/1971 | Neufeld | 312/263 |
| 4,077,686 | 3/1978 | Bukaitz | 312/257 R |

FOREIGN PATENT DOCUMENTS

| | | | |
|---|---|---|---|
| 1590062 | 4/1970 | Fed. Rep. of Germany | 312/257 A |
| 2386965 | 11/1978 | France | 312/263 |

*Primary Examiner*—Victor N. Sakran

*Attorney, Agent, or Firm*—C. Frederick Leydig; Richard L. Voit; David J. Richter

[57] ABSTRACT

A rectangular metal cabinet of the panel type intended for sale and transport in a knocked-down condition for assembly with self-tapping screws penetrating the mated edges of the panels. The rear panel has flanges along its lateral edges and the side panels have flanges along their front edges, the flanges being of the box type to impart torsional rigidity at the four upright corners of the cabinet and to receive as well as shield and conceal the tips of the self-tapping screws. The cabinet has one or more rectangular shelves dimensioned to extend to the walls thereof, with the upright flanges being notched out at shelf level by an amount equal to the thickness dimension of the shelf to enable engagement between the edges of the shelf and the walls of the cabinet as well as support for the shelf in the vertical direction. The rear panel consists of left and right-hand sections which are symmetrical and of identical width having box type flanges at their central edges joined in abutting relation. Each of the doors has a flange of box type extending about the periphery to define a central panel. A reinforcing channel having integral wing portions is rigidly adhered to the panel. The wing portions are angled at a shallow angle to define holding spaces of sharply acute cross section containing a charge of adhesive. The structure is preferably fabricated by punching and bending of prefinished stock with avoidance of localized heating by spot welding or the like.

12 Claims, 10 Drawing Figures

11
21
21'
16
14
17
20
11
16
13
83
15a
15b
81
85
86
82
21
83'
14
81'
85'
86'
17
21'
83'
82'
84
81'
85'
86'
21'
83'
82'
84'
81'
85'
86'
21'
82'
84'
84'
12
20

METAL CABINET FOR ASSEMBLY BY THE USER FROM KNOCKED-DOWN CONDITION

The art of making metal cabinets is highly developed and it is well known to form cabinets of flanged metal panels joined together at mating edges by self-tapping screws or the like. The flanges in such prior cabinets take various forms, all of the way from straight, or unbent, flanges to flanges of "L" (singly bent), "C" (doubly bent), and "box" shape. For the most part metal cabinets have been pre-assembled, finished, usually by spray coating, and packed in a full-sized protective carton or the like for storage and shipment. Most of the construction techniques are suited for use only with cabinets which are pre-assembled at the factory and in which spot welding is the most common mode of fastening the parts together. As a generality, cabinets are not constructed and fitted in a way which permits on-site assembly. On the other hand efforts to produce a cabinet which can be assembled by the user have been characterized by poor structural techniques frequently resulting in a shoddy looking, "tinny" product of limited strength and rigidity and with the inside of the cabinet showing raw metal edges and exposed, projecting screw points which are both unsightly and hazardous.

Prior constructions have often utilized door reinforcing channels as shown, for example, in prior U.S. Pat. No. 3,023,068 with such channels being generally spot welded in place. The weld spots at spaced intervals result in concentrations of stress as the door is warpingly deformed which may occur, for example, when one corner of the door "sticks" as the door is opened. The weld spots, moreover, form depressions or dimples in the outer surface of the door which deface the door and add to the "cheap" appearance. Moreover, use of welding techniques in cabinet constructions precludes the use of pre-finished or pre-coated stock. The necessity for a final finishing step greatly limits the finishes which may be employed, ruling out, for example, the use of decorative "printed" designs.

It is, accordingly, an object of the invention to produce a metal cabinet which is intended for sale and transportation in a knocked-down condition for assembly by the user at the point of use. It is, therefore, a general object of the invention to provide a cabinet construction which possesses all of the advantages of sale and transport in a knocked-down state including densified economical shipment, conservation of storage and floor space at the dealer, convenient "take home" handling on the part of the buyer and a high degree of economy at each step in the process of manufacturing and distribution resulting in a substantial saving which, in a competitive market, serves to benefit the consumer. Erection at point of use enables use of the cabinet, particularly where of large size, in places where it would be difficult or impossible to take a pre-assembled cabinet as, for example, in an attic or other space having a narrow or difficult access opening.

It is another, and related, object to provide a cabinet construction which may be pre-finished or pre-coated in a wide variety of finishes and designs on the flat sheet metal stock with the stock being fed to the punching and bending machines conveniently from a pre-coated and re-rolled web. This enables use of a wide variety of printed designs which are preserved intact to the customer, free of any marring due to the cutting and bending operations and without the damage to the finish which always accompanies use of spot welding. Preprinting by an adherent and bendable finish may be performed on a cost per square foot which is only a fraction of the cost of spray painting, for example.

It is another object to provide a cabinet construction which is inherently easy to erect, in which the parts slip into place logically and without necessity for detailed assembly instructions, requiring only the application of a limited number of self-tapping screws to provide a monolithic assembly which remains permanently tight.

It is yet another object to provide a cabinet construction which is exceptionally strong and rigid, which employs box-type flanges throughout at all critical points, particularly at all four upright corners of the cabinet, and in the doors, to impart a high degree of torsional rigidity. It is a related object to provide a cabinet which can be made of relatively light gauge metal and in which the metal is stressed efficiently to develop high strength and durability, completely avoiding any "tinny"effect. Thus it is an object to produce a cabinet intended for heavy duty loading and capable of withstanding rough usage, a cabinet in which the shelves, for example, may be severely overloaded without damage.

In this connection it is an object to provide a cabinet having a door construction employing box-type flanges about its periphery plus a reinforcing channel of special construction cemented with adhesive to produce a weld-free door characterized by a high degree of torsional stability, a door in which the torsional stresses which are set up under some conditions are resisted with stress distributed on an "area" basis minimizing warp-type deformation. Indeed, the solidity of the door construction as compared to the filmsy doors provided on a conventional cabinet adds greatly to the appeal and saleability of the entire unit.

It is yet another object to provide a metal cabinet construction which is almost entirely free of evidence of hardware both inside and out. Externally visible screw heads are at a minimum and the construction is such that the box-type flanges which are employed not only receive, but shield and conceal, the tips of the self-tapping screws which are used in the construction. The lack of visible hardware and projecting points not only creates a rich and finished internal appearance but results in a safe construction in which clothing or other items which are stored in the cabinet cannot be inadvertently caught and torn on a projecting screw tip, nor fingers cut or scratched.

It is still another object to provide a metal cabinet intended for sale and transport in a knock-down condition which is easily and economically manufactured because of the use of simple repetitive shapes and bends, use of duplicate parts, compact packaging, and almost entire saving of assembly expense. Tooling expense is minimized since the tooling is relatively simple and since the same tooling can be economically employed in the construction of differently shaped panels. The cabinet may be constructed in a wide range of sizes and outfitted, without major change of design, for a wide variety of usage, either with shelves or without.

Other objects and advantages of the invention will be apparent upon reading the attached detailed description and upon reference to the accompanying drawings in which.

Figure 3:
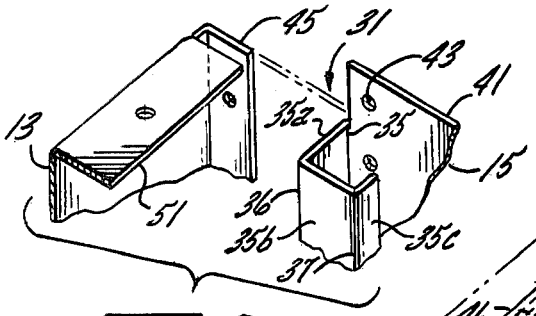
Figure 3A:
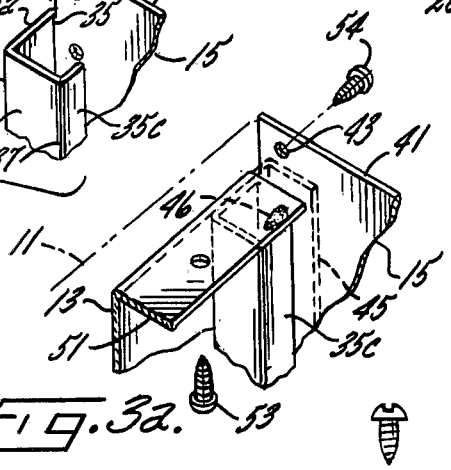

FIGS. 3 and 3*a* are fragmentary perspective views showing a corner detail in the exploded and partially assembled state, respectively.

Figures 1, 2:
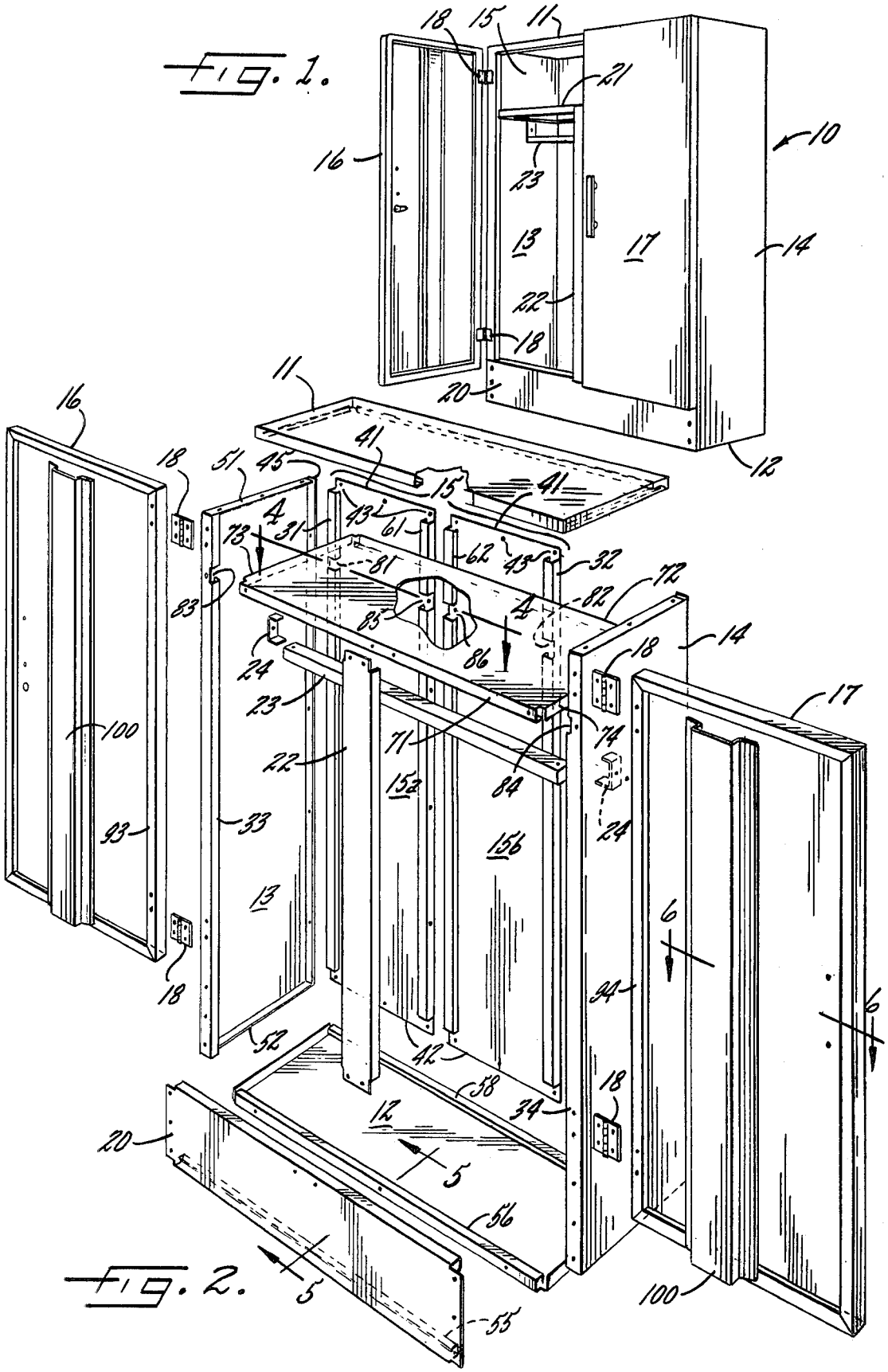
FIG. 1 is a perspective view showing a cabinet constructed in accordance with the invention in its assembled state, the cabinet being intended for use as a wardrobe.
FIG. 2 is an exploded view showing the metal panels which are assembled to form the cabinet of FIG. 1.
Figure 4:
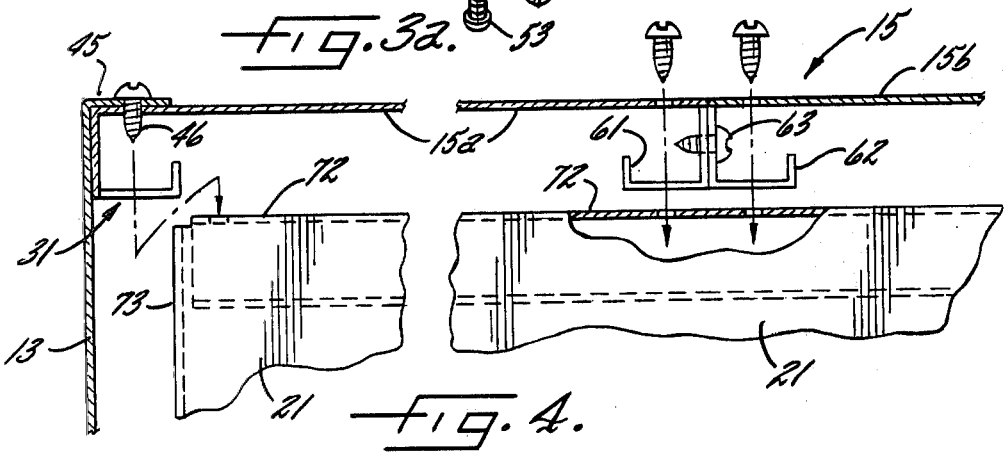

FIG. 4 is a fragmentary section looking along line 4—4 in FIG. 2.

Figure 5:
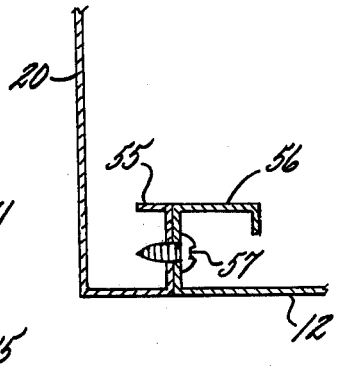

FIG. 5 is a fragmentary section looking along line 5—5 in FIG. 2.

Figure 6A:
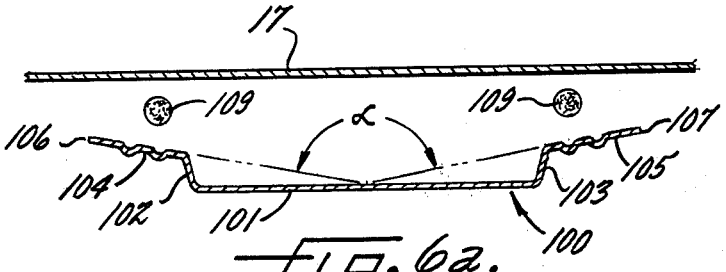
Figure 6:
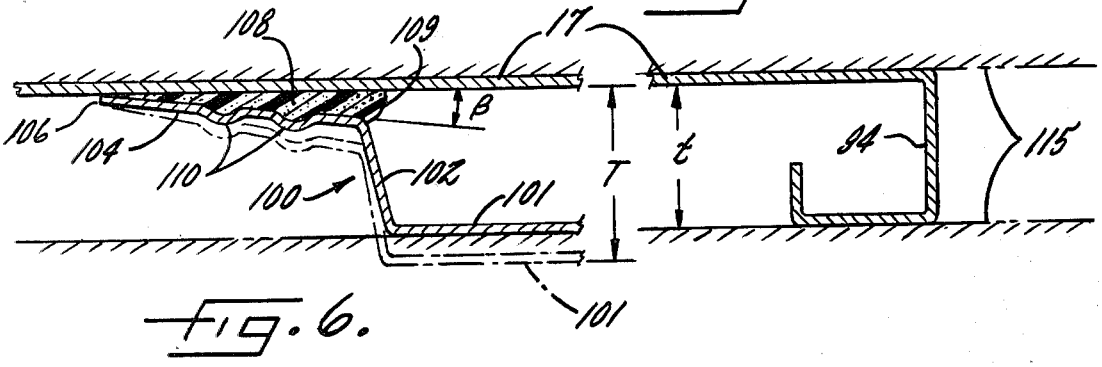

FIG. 6 is a fragmentary section taken through the assembled door structure looking along line 6—6 in FIG. 2.

FIG. 6*a* is a cross section similar to FIG. 6 but showing assembly of the reinforcing channels to the door panel with interposed adhesive.

Figures 7, 8:
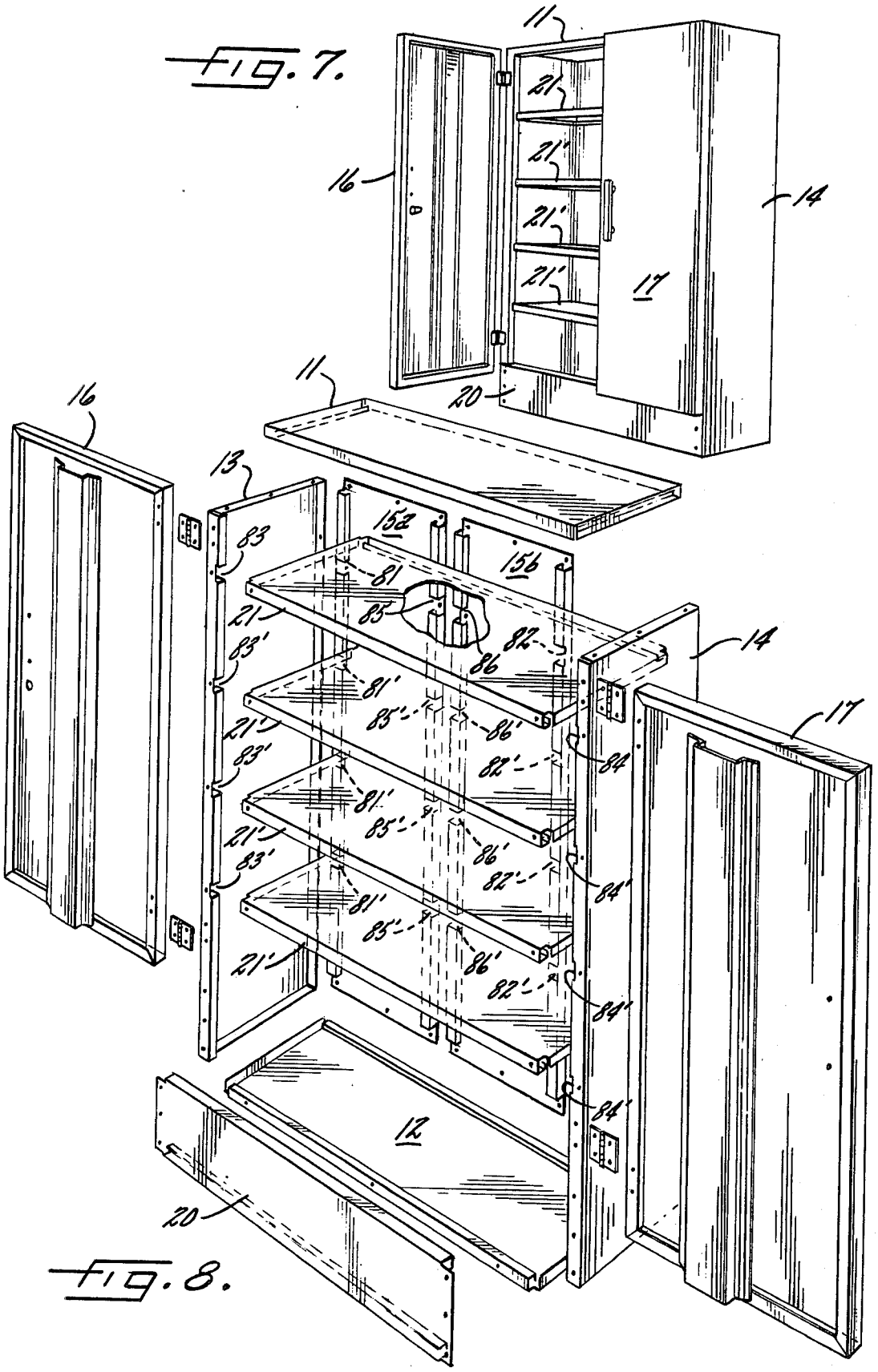

FIG. 7 is a perspective view similar to FIG. 1 but showing a cabinet of modified design.

FIG. 8 is an exploded perspective corresponding to the structure of FIG. 7.

While the invention has been described in connection with certain preferred embodiments of the invention, it will be understood that we do not intend to be limited to the particular embodiments shown but intend, on the contrary, to cover the various alternative and equivalent constructions included within the spirit and scope of the appended claims.

Turning now to the drawings there is shown in FIG. 1 a cabinet 10 constructed in accordance with the invention, used as a wardrobe, the same cabinet in its disassembled state being illustrated, in exploded condition, in FIG. 2. However, it will be understood that the various parts of the cabinet, sold in knocked-down condition, are, upon leaving the factory, densely packaged, with the panels nested flatly together in a wrapping or container of small dimension. The cabinet includes a top panel 11, a bottom panel 12, side panels 13, 14, a rear panel 15 and a pair of doors 16, 17 mounted on hinges 18.

Below the doors there is mounted a "kick" panel 20, forming a shallow internal well for rubbers or the like. Inside of the cabinet, toward the top, is a shelf 21. The shelf 21 is supported, at its center, upon a column 22 which extends downwardly to engage the top edge of the "kick" panel. For receiving of garments on conventional hangers a horizontal bar 23 is secured, at its ends, to small brackets 24 mounted on the side walls. All of these parts are made of thin gauge metal, preferably steel, having a gauge which depends upon the size of the cabinet and the use to which it is to be put but which may, for example, be 26 gauge.

In accordance with the present invention the rear panel has box type flanges 31, 32 along its lateral edges and the side panels have box-type flanges 33, 34 along their front edges to impart torsional rigidity at all four upright corners of the cabinet. By a "box-type" flange is meant an edge which is bent along three parallel crease lines to form a contained space of rectangular cross section which is closed on three sides and at least partially closed on the fourth side. Taking the flange 31 on the back panel 15 by way of example, it will be noted in FIG. 3 that the parallel crease lines, indicated at 35, 36 and 37 define a first closed side 15, a second closed side 35*a*, a third closed side 35*b* and a fourth, partially closed, side 35*c*.

The box-type flanges 31, 32, it will be noted, stop short of the upper and lower edges of the panel to define upper and lower "straight" flanges 41, 42 which overlap the rear edges of the top and bottom panels 11, 12, respectively. The top and bottom panels are preferably formed with a box-type flange at the regions of overlap to receive and conceal the tips of the self-tapping screws which penetrate suitable openings 43 formed in the straight flanges, which openings are aligned with openings (not shown) along the rear edges of the top and bottom panels, respectively.

In carrying out the invention the rear lateral edges of the side panels 13, 14 are each formed with an "L" type flange 45 which extends around and in back of the rear panel 15 in an overlapping position aligned with the box-type flanges 31, 32 on the latter, with self-tapping screws penetrating each "L" type flange and with the tips of the screws, as indicated at 46, (FIGS. 3*a* and 4) projecting into the associated box-type flange. It will be apparent that since the screw tip 46, and the other screw tips in the series, being enclosed in a box-type flange, are shielded from view and even more importantly are shielded from catching on any garments or other objects which may be stored in the cabinet.

The upper and lower edges of the side panels 13, 14 terminate in "L" type flanges 51, 52, with the flange 51 serving as a flat seat for supporting the top panel 11 which is held in place by means of a set of upwardly directed screws 53 (FIG. 3*a*) and a set of forwardly directed screws 54 penetrating openings 43 along the upper edge of the back panel. The tips of the screws 53, 54 are both shielded by the box-type flange formed at the adjacent end of the top panel.

The shielding of the screw tips has been carried throughout the construction as shown in the fragmentary section FIG. 5. This figure shows the joint between the kick panel 20 and the bottom panel 12 which carry box-type flanges 55, 56, respectively, which are in abutting relation and held together by a series of screws 57. It will be noted in the joint of FIG. 5 that both the head and the tip of the screw are fully shielded. A similar box-type flange 58 mates with the straight type flange formed at the lower edge 42 of the back panel (FIG. 2).

In accordance with one of the aspects of the present invention the rear panel 15 is in the form of two vertical sub-panels, that is, it consists of left and right-hand sections, having box-type flanges at their central edges joined in abutting relation by self-tapping screws in which the head of each screw is concealed in one flange and the tip in the other, the sections preferably being symmetrical and of identical width. Thus referring to FIGS. 2 and 4, the rear panel indicated generally at 15 consists of two sections, a left-hand section 15*a* and complementary right-hand section 15*b* with box-type flanges 61, 62 thereon joined in abutting relation by a series of screws 63. The sections 15*a* and 15*b* of the rear panel are shown in FIG. 2, for convenience, at reduced width; the width in fact corresponds to that of the doors.

Making the rear panel 15 in this fashion is accompanied by a number of advantages: In this first place the central box flanges impart substantial torsional rigidity which comes about by the breaking up of a large expanse of metal of single thickness and by the fact that box-type flanges are used rather than flanges of simpler type. A second main advantage is that the sections 15*a*, 15*b* of the back panel, are of half size, being equal in width to the doors 16, 17 which are the next largest of the components, thereby permitting more compact building into a package for transport and storage.

In accordance with one of the features of the invention the rectangular shelf, indicated at 21, is dimensioned to extend to the walls of the cabinet with downwardly-turned edges to define a thickness dimension, the box-type flanges 31, 32 and 33, 34 being notched out at shelf level by an amount equal to the thickness dimension of the shelf to accommodate engagement between the edges of the shelf and the walls as well as to provide support for the shelf in vertical loading. Thus the shelf 21 has front and rear downwardly turned flanges 71, 72 and end flanges 73, 74, at least the flanges 71, 72 being of the box type. For the purpose of accepting the corners of the shelf the flanges 31–34 are respectively notched out as indicated at 81–84. Where the rear panel 15 is formed in two sections, with flanges 61, 62 thereon abutted together, such flanges are also notched out at shelf level to the thickness dimension of the shelf as indicated at 85, 86 (FIG. 2).

In accordance with one of the features of the invention the doors 16, 17 are formed with peripheral box type flanges as indicated at 93, 94 (FIG. 2), the door hinges 18 each having a pair of flaps, with self-tapping screws for penetrating the same for securing the hinges to the box-type flanges on the doors and side panels, with the tips of the screws being received in a shielded and concealed position (see FIG. 1).

For augmenting the torsional rigidity of the doors, each of the doors is provided with a reinforcing metal channel having integral wing portions extending continuously along the sides thereof and symmetrically angled in the direction of the central panel of the door so as to make a shallow obtuse angle with one another and so that, when the remote edges of the wing portions are in contact with the door panel, cement-holding spaces of sharply acute cross section are formed, with a charge of adhesive cement being applied in the holding spaces for rigidly bonding the channel to the door panel.

Thus, taking the door 17 as representative, a reinforcing channel is applied having the shape shown in profile in FIGS. 6 and 6*a*. The reinforcing channel 100 has a flat central portion 101, sides 102, 103, and integral wing portions 104, 105. The wing portions extend continuously along the sides of the channel and are symmetrically angled in the direction of the central door panel so as to make a shallow obtuse angle with one another as indicated at $\alpha$ (FIG. 6*a*). As a result when the remote edges 106, 107 of the wing portions are in contact with the door panel, a cement holding space 108 (FIG. 6) is formed having a sharply acute cross section as indicated by the angle $\beta$. Into this holding space is placed a charge of adhesive 109 (FIG. 6*a*). Such adhesive may preferably consist of a quick setting two-part urethane composition known in the art.

This is the only part of the construction which requires pre-assembly: A strip of adhesive 109 is applied by a gun or the like interposed between the panel 17 and the wing portions 104, 105 of the reinforcing channel, and the channel is then pressed into position as shown in FIG. 6. This causes the cement to spread, but because of the concentrated contact which exists at the outer edges 106, 107 of the wing portion, the adhesive does not escape outwardly but any excess crowds inwardly into the body of the channel where it is out of sight. Thus the adhesive need not be applied with great care and there is no need to wipe any of the excess away. The wing portions 104, 105 are preferably formed with one or more ribbed embossments 110 to provide longitudinal grooves into which the cement extends to produce a strong bond between the cement and the inner surface of the channel. Preferably the thickness dimension of the reinforcing channel exceeds the door thickness in the original or unstressed state, and the wing portions 104, 105 have sufficient resiliency so that when the reinforcing channel has been pressed into its seated and cemented position the channel is substantially flush with the box-type flanges on the door.

Thus referring to FIG. 6 where the door thickness is indicated at t, the reinforcing channel has an initial thickness of T which exceeds t by a small amount. Thus, after the adhesive has been applied and the channel located in position, the door is clamped between two opposed clamping surfaces 115 (FIG. 6) which squeeze the reinforcing channel toward the door panel, slightly flattening the channel until it occupies a parallel position substantially flush with the box-type flanges at the periphery of the door. This is accompanied by an internal spreading-out of the adhesive so that it adheres to almost the entire presented surface area. At the same time, using metal for the channel which is resilient and flexible, the clamping overcomes, and permanently removes, any "waviness" either at the edges of the channel or in the door panels themselves. As soon as the adhesive has set, the clamping surfaces may be removed.

By making the channel the same effective thickness as the box flange 94, the door may seat flatly with respect to the front edge 71 of the shelf 21, and against the front edge of any additional shelves, if used, so that the shelves reinforce the door against forces which may be applied to the central portion of the door panels. Moreover, making the channels of such "maximum" thickness, in other words by making the channels as "boxy" as possible within the door thickness limitations, results in maximum resistance to torsional, or warping, type deflection, without substantially subtracting from the cubic capacity of the cabinet. However, it will be recognized that if desired the channels may be tailored to a final thickness which is uniformly less than the thickness t of the box flange by inserting a shim of uniform thickness between the inner clamping surface (lower clamping surface as viewed in FIG. 6) and the channel when the parts are clamped together.

It is found that use of an adhesive 109 such as polyurethane, with extensive and continuous area engagement with both of the adhered surfaces has numerous advantages over the usual spot welding techniques. In the first place it permits use of pre-finished stock, the surface finish of which would be locally destroyed by the welding heat while, at the same time, avoiding the unsightly "dimples" which always accompany use of spot welding, as already mentioned. Moreover, welds, particularly where made in the usual limited number, form concentrated stress points as the door is torsionally twisted, or warped, incident to hard usage, whereas by using adhesive in a continuous and extensive layer, warping forces are distributed and resisted uniformly over a large area of adhered surface resulting in high strength, reliability and a long useful life.

There is still another advantage in the use of a channel formed and adhered as described above, and that is that the charge of adhesive in the sharply arcuate space serves as a muffling or dampening agent, avoiding the "tinniness" of the usual metal door constructed in large size of thin metal and providing a more "solid" sound and feel.

While the cabinet constructed in accordance with the present invention is particularly applicable to use as a wardrobe, as shown in FIGS. 1 and 2, it is equally usable with only minor modification as a cabinet containing a full complement of shelves as illustrated in FIGS. 7 and 8. In these figures corresponding elements have, for the sake of simplicity, been given the same reference numerals as in the earlier wardrobe embodiment, and the added elements have been given corresponding reference numerals plus a prime. Thus there are, in addition to the shelf 21, three additional shelves 21' which are preferably identical thereto. Whereas the original shelf 21 was described as fitted at the corners into notches 81–84 formed in the cornerposts 31–34, respectively, the added shelves 21' are fitted at their corners in notches 81'–84'. Similarly, where the original shelf 21 was accommodatingly received in notches 85, 86 in the box flanges 61, 62 at the center of the rear panel, matching notches 85', 86' are provided at shelf level for the reception and support of the additional shelves 21'. While the additional notches 81'–86' have an inevitable effect upon the monolithic integrity of the box flanges in which they are formed, any loss of strength in the box flanges due to the notching is more than made up for by the bracing effect of the installed shelves. Preferably the notches 81'–86' are tailored to the thickness dimension of the edge flanges of the shelves so that the cornerposts formed by the flanges 31–34, as well as the back posts formed by the box flanges 61, 62 in the rear panel provide direct support for any heavy load which may be placed upon one of the shelves; thus total reliance for support of shelf loading need not be placed upon the self-tapping screws which engage the shelf flanges. Accordingly, the term "support" as used herein is not limited to the type of support which would be provided at a tightly fitted, notched joint. On the contrary the notches 81'–86' are preferably made a slight amount oversize to facilitate assembly so that bearing contact may not be uniformly achieved by each shelf at each supporting post. Thus the term "support" as applied to the notched posts refers not only to the actual support upon initial assembly but to the potential support which may occur upon failure or loosening of the self-tapping screws at the post positions. Each shelf is positively and reliably supported even though the assembler, due to lack of following of the assembly instructions, may fail to insert or tighten some of the screws in the construction.

It will be apparent that the features and advantages of the invention, stated earlier, have been abundantly realized. Erection is easy and obvious, with most of the parts dropping quite logically into their pre-assigned positions, even for one who may be totally uninformed on cabinet construction to produce a structure which is inherently strong and rigid and which is distinguished, both inside and out, by a clean "finished" appearance, with no screw tips and only a limited number of screw heads being visible to a casual observer. The structure, as described, is distinguished by a total lack of welding and all of the parts are simply formed from stock which may be, and preferably is, pre-finished, resulting in a high degree of attractiveness and economy.

Although it is preferred to use the usual pointed and hardened self-tapping screws applied by a screwdriver in the usual way, and while conventional self-tapping screws have the advantage that access to the inner end is not required, it will be apparent to one skilled in the art that an equivalent two-piece fastener may be used without departing from the invention. For example, the holes formed in the metal may be simply clearance holes and holding effect may be achieved by threading the screws into a receiving nut or clip at the inner end, which nut, or clip, may be formed from a plastic such as nylon or from metal, either with or without the self-tapping effect.

While the shelves have been referred to as being dimensioned to provide "engagement" with the side walls, such term refers to a cooperative relationship which may stop short of actual touching.

In the preferred embodiment of the present invention flanges of the box type are employed not only for maximum torsional rigidity but for receiving, shielding and concealing the tips of the self-tapping screws used in the assembly. It will be appreciated by one skilled in the art that the invention, in certan of its aspects, is not limited thereto and that such worthy objectives can be largely satisfied by use of flanges which are doubly bent into squared "C" configuration rather than triply bent. Such a modification might be desired, for example, where it is desired to produce a cabinet which partakes of the advantages described above but which is intended for maximum economy of manufacture.

What we claim is:

1. In a rectangular metal cabinet construction the combination comprising top and bottom panels, side panels, and an extensive rear panel all having mated edges as well as a pair of front doors and intended for sale and transport in a knocked-down condition for assembly with self-tapping screws penetrating the mated edges, the rear panel having flanges along its lateral edges, the side panels having flanges along their front edges, the flanges being of the box type to impart torsional rigidity at the four upright corners of the cabinet and to receive as well as shield and conceal the tips of the self-tapping screws upon penetration thereof, a rectangular shelf in the cabinet dimensioned to extend to the walls thereof and having downwardly turned edges to define a thickness dimension, the box type flanges being notched out at the shelf level by an amount equal to the thickness dimension of the shelf to enable engagement between the edges of the shelf and the walls as well as support for the shelf in the vertical direction.

2. The combination as claimed in claim 1 in which the rear panel consists of left and right sections having flanges at their central edges, the flanges being of the box type and joined in abutting relation by self-tapping screws having the head thereof in one flange and the tip in the other, the flanges at the central edges being also notched out at shelf level to the thickness dimension of the shelf for accommodation and support of the latter.

3. The combination as claimed in claim 1 in which each of the doors has a flange of the box type extending about the periphery to a constant door thickness thereby to define a central panel consisting of a single thickness of metal, a metal reinforcing channel extending vertically on the inner face of the panel in working position, the reinforcing channel having integral wing portions extending continuously along the sides thereof symmetrically angled in the direction of the central panel so as to make a shallow obtuse angle with one another so that when the remote edges of the wing portions are in contact with the door panel cement holding spaces of sharply acute cross section are formed, and a charge of adhesive in the holding spaces for rigidly bonding the members together for augmenting the torsional rigidity of the panel.

4. The combination as claimed in claim 3 in which the wing portions have sufficient resiliency so that when the reinforcing channel is flatly seated in its working position, the outer edges of the wing portions are in continuous and concentrated bearing engagement with the central panel thereby effectively sealing the adhesive holding spaces against outward escape of adhesive.

5. The combination as claimed in claim 3 in which the wing portions of the reinforcing channel are longitudinally formed with a ribbed embossment to provide longitudinal grooves into which the adhesive extends to provide a strong bond between the adhesive and the channel.

6. In a rectangular metal cabinet construction the combination comprising top and bottom panels, side panels, and an extensive rear panel all having mated edges as well as a pair of front doors and intended for sale and transport in knocked-down condition for assembly with self-tapping screws penetrating the mated edges, the rear panel having upper and lower edges and having box flanges along its lateral edges, the side panels having box flanges along their front edges, the top and bottom panels each having box flanges along at least their rear edges, the box flanges serving to impart torsional rigidity at the four upright corners of the cabinet and to receive as well and shield and conceal the tips of the self-tapping screws upon penetration thereof, the box flanges on the rear panel stopping short of the upper and lower edges of the panel to define upper and lower straight flanges for respectively overlapping the box flanges on the top and bottom panels.

7. The combination as claimed in claim 6 in which the rear panel consists of left and right sections having flanges at their central edges, the flanges being of the box type and joined in abutting relation by self-tapping screws having the head thereof concealed in one flange and the tip concealed in the other, the sections being symmetrical and of identical width, the box flanges at the central edges of the sections stopping short of the upper and lower edges of these sections so that the straight flanges extend over the width of the rear panel for reception of screws for anchoring the rear panel as closely spaced intervals to the top and bottom panels.

8. The combination as claimed in claim 1 or in claim 6 in which the rear lateral edges of the side panels are each formed with an "L" type flange which extends around and in back of the rear panel in an overlapping position aligned with the box type flanges on the latter to form a substantially flush rear surface, and self-tapping screws penetrating each "L" type flange from the rear with their tips projecting into the associated box type flange for concealment therein, the side panels and the rear panel each having a flange along the top edge thereof for nested reception and retention of the top panel.

9. The combination as claimed in claim 1 or in claim 6 in which the edges of the doors are formed with peripheral box type flanges, a set of door hinges for each door each including a pair of flaps for securing the same, and self-tapping screws penetrating the flaps of the hinge for securing the hinges to the box type flanges on the doors and side panels with the tips of the screws being received therein in a shielded and concealed position.

10. A metal door for a cabinet comprising in subcombination, a body consisting of a single thickness of metal having an integral flange of the box type extending about its periphery to a constant door thickness thereby to define a central panel consisting of a single thickness of metal, a metal reinforcing channel extending vertically on the inner face of the panel, the reinforcing channel having integral wing portions extending along the sides thereof symmetrically angled in the direction of the central panel so as to make a shallow obtuse angle with one another so that when the remote edges of the wing portions are in contact with the door panel cement-holding spaces of sharply acute angular cross section are formed, the wing portions having sufficient resiliency so that when the reinforcing channel is seated in parallel working position the outer edges of the wing portions are in continuous and concentrated bearing engagement with the central panel, and a charge of adhesive throughout the cement-holding spaces for rigidly bonding the members together with uniform stress distribution for augmenting the torsional rigidity of the panel.

11. In a rectangular metal cabinet construction the combination comprising top and bottom panels, side panels, and an extensive rear panel all having mated edges as well as a pair of front doors and intended for sale and transport in a knocked-down condition for assembly with self-tapping screws penetrating the mated edges, flanges extending vertically along the the front edges of the side panels and at the junctions of the side panels and the rear panel, the flanges being at least doubly bent to form posts imparting torsional rigidity at the four upright corners of the cabinet and to receive as well as shield and conceal the tips of the self-tapping screws upon penetration thereof, the rear panel being formed in symmetrical left and right complementary sections having abutting box flanges at their central edges, such flanges being bent in the same direction along three parallel crease lines to form boxes of substantially square cross section each having four walls with a second one of the walls thereof being in abutting relation to one another, the second walls having registering holes for self-tapping screws having the heads thereof concealed in one flange and the tips concealed in the other for clamping the sections together, the fourth wall of each box being narrower than the rest for admission of the screws as well as a tool for tightening the same, the respective left and right door panels having a width corresponding to the sections of the rear panel for compact packaging of the panels in knocked-down condition.

12. In a rectangular metal cabinet construction the combination comprising top, bottom, side and rear panels all having mated edges as well as at least one front door panel intended for sale and transport in a knocked-down condition for assembly with self-tapping screws penetrating the mated edges, and flanges of the box type on at least two opposite marginal edges of the top, bottom, rear and door panels to provide torsional rigidity and to receive, as well as shield and conceal, the tips of the self-tapping screws upon penetration thereof.

* * * * *